US010113819B2

(12) United States Patent
Stewart et al.

(10) Patent No.: US 10,113,819 B2
(45) Date of Patent: Oct. 30, 2018

(54) FIREARM RECEIVER WITH FORWARD ASSIST AND BOLT CATCH RELEASE

(71) Applicant: WIPH, LLC, St. George, UT (US)

(72) Inventors: Skylar J. Stewart, Ivins, UT (US); Thomas J. Ahey, IV, St. George, UT (US); Michael H. Walther, St. George, UT (US)

(73) Assignee: WIPH, LLC, SL George, UT (US)

( * ) Notice: Subject to any disclaimer, the term of this patent is extended or adjusted under 35 U.S.C. 154(b) by 0 days.

(21) Appl. No.: 15/416,490

(22) Filed: Jan. 26, 2017

(65) Prior Publication Data

US 2017/0191770 A1 Jul. 6, 2017

Related U.S. Application Data

(63) Continuation of application No. 14/738,203, filed on Jun. 12, 2015, now Pat. No. 9,557,125.

(60) Provisional application No. 62/105,038, filed on Jan. 19, 2015, provisional application No. 62/011,265, filed on Jun. 12, 2014.

(51) Int. Cl.

| | |
|---|---|
| ***F41A 3/72*** | (2006.01) |
| ***F41A 17/36*** | (2006.01) |
| ***F41A 35/06*** | (2006.01) |
| ***F41A 3/66*** | (2006.01) |

(52) U.S. Cl.

CPC ..... *F41A 3/72* (2013.01); *F41A 3/66* (2013.01); *F41A 17/36* (2013.01); *F41A 35/06* (2013.01)

(58) Field of Classification Search

CPC ..... F41A 9/00; F41A 9/59; F41A 9/65; F41A 9/70; F41A 17/34; F41A 17/36; F41A 17/38; F41A 17/42; F41A 3/66; F41A 3/68; F41A 3/72; F41A 7/00; F41A 35/06

USPC ..... 42/14–16; 89/1.4

See application file for complete search history.

(56) References Cited

U.S. PATENT DOCUMENTS

| | | | |
|---|---|---|---|
| 1,247,528 | A | 11/1917 | Hammond |
| 1,533,966 | A | 4/1925 | Browning |
| 4,128,042 | A | 12/1978 | Atchisson |
| 4,664,015 | A | 5/1987 | Kennedy |

(Continued)

OTHER PUBLICATIONS

Notification of Transmittal of the International Search Report and the Written Opinion of the International Searching Authority, or the Declaration; International Patent Application No. PCT/US2016/064964, WIPH, LLC (Walther, Michael H., et al); dated Feb. 24, 2017.

(Continued)

*Primary Examiner* — Stephen Johnson
*Assistant Examiner* — Benjamin S Gomberg
(74) *Attorney, Agent, or Firm* — Gurr Brande & Spendlove, PLLC

(57) ABSTRACT

A receiver for a firearm may include a linkage that integrates movement of left and right forward assists. The receiver may include a linkage connecting one or both of the forward assists to a bolt catch. The receiver may included both a connection between the left and right forward assists as well as a connection between one or both of the forward assists and the bolt catch. The receiver may include a linkage connecting the forward assist mechanism with the bolt catch mechanism such that actuation of the forward assist mechanism moves the bolt carrier and moves the bolt catch mechanism from the engaged position to the disengaged position.

20 Claims, 8 Drawing Sheets

(56) References Cited

U.S. PATENT DOCUMENTS

| | | | | |
|---|---|---|---|---|
| 5,519,954 | A | 5/1996 | Garrett | |
| 6,070,352 | A | 6/2000 | Diagle | |
| 6,907,814 | B2 | 6/2005 | Spinner et al. | |
| 7,047,864 | B2 | 5/2006 | Spinner et al. | |
| 7,219,462 | B2 | 5/2007 | Finn | |
| 7,661,219 | B1 | 2/2010 | Knight, Jr. et al. | |
| 7,798,045 | B1 * | 9/2010 | Fitzpatrick | F41A 21/481 42/69.02 |
| 7,849,777 | B1 * | 12/2010 | Zedrosser | F41A 3/26 42/16 |
| 8,156,854 | B2 * | 4/2012 | Brown | F41A 3/72 89/1.4 |
| 8,161,861 | B2 | 4/2012 | Haley et al. | |
| 8,261,652 | B2 | 9/2012 | Findlay | |
| 8,327,749 | B2 | 12/2012 | Underwood | |
| 8,359,966 | B1 | 1/2013 | Brotherton | |
| 8,387,296 | B2 | 3/2013 | Overstreet et al. | |
| 8,479,635 | B2 | 7/2013 | Overstreet et al. | |
| 8,561,517 | B2 | 10/2013 | Brown | |
| 8,572,875 | B2 | 11/2013 | Sisgold | |
| 8,713,832 | B2 | 5/2014 | Troy et al. | |
| 8,826,797 | B2 * | 9/2014 | Overstreet | F41A 35/06 89/128 |
| 9,097,474 | B1 | 8/2015 | Zins et al. | |
| 9,541,339 | B2 | 1/2017 | Orne, III et al. | |
| 9,557,125 | B2 * | 1/2017 | Stewart | F41A 3/72 |
| 9,599,419 | B2 | 3/2017 | McGinty | |
| 2005/0000138 | A1 | 1/2005 | Kiss | |
| 2005/0183310 | A1 | 8/2005 | Finn | |
| 2007/0006720 | A1 | 1/2007 | Liao | |
| 2010/0275485 | A1 | 11/2010 | Findlay | |
| 2011/0056107 | A1 | 3/2011 | Underwood | |
| 2011/0252957 | A1 | 10/2011 | Overstreet et al. | |
| 2012/0167424 | A1 | 7/2012 | Gomez | |
| 2012/0174451 | A1 | 7/2012 | Overstreet et al. | |
| 2012/0180354 | A1 | 7/2012 | Sullivan et al. | |
| 2012/0297656 | A1 | 11/2012 | Langevin et al. | |
| 2013/0014416 | A1 | 1/2013 | Sisgold | |
| 2013/0152442 | A1 | 6/2013 | Underwood | |
| 2014/0060310 | A1 | 3/2014 | Overstreet et al. | |
| 2014/0150639 | A1 | 6/2014 | Sugg et al. | |
| 2015/0101230 | A1 | 4/2015 | Curtis | |
| 2015/0198400 | A1 | 7/2015 | O'Dell | |
| 2015/0323271 | A1 | 11/2015 | McGinty | |
| 2017/0082385 | A1 | 3/2017 | Orne, III et al. | |
| 2017/0160026 | A1 | 6/2017 | Walther et al. | |

OTHER PUBLICATIONS

Notification and Transmittal of the International Search Report and the Written Opinion of the International Searching Authority, or the Declaration, PCT/US2015/035669, Wilson Precision Arms, Inc. (Stewart, Skylar J, et al), dated Sep. 14, 2015.

* cited by examiner

FIREARM RECEIVER WITH FORWARD ASSIST AND BOLT CATCH RELEASE

This application is a continuation of U.S. patent application Ser. No. 14/738,203 (now U.S. Pat. No. 9,557,125), filed on Jun. 12, 2015, which claims priority to U.S. Provisional Patent Application No. 62/011,265, filed on Jun. 12, 2014, and to U.S. Provisional Patent Application No. 62/105,038, filed on Jan. 19, 2015. Each of which is hereby incorporated by reference in its entirety.

FIELD OF THE INVENTION

The present invention relates to a receiver for a firearm. In particular, the present invention relates to a receiver for a firearm having a forward assist combined with a bolt catch release.

BACKGROUND OF THE INVENTION

Rifles, such as the AR-15 and its derivatives include a forward assist. The forward assist is usually located near the bolt closure. When the forward assist is actuated, it pushes the bolt carrier forward, ensuring that the bolt is locked. It is commonly incorporated into standard loading procedure to prepare a weapon for firing, or to close the bolt when the weapon is excessively dirty. It can also be used to close a bolt that was gently let down, rather than released under full spring compression, to keep the noise of closing the bolt to a minimum.

In addition, many semi-automatic firearms, including the AR-15 include a bolt catch. A bolt catch is a lever usually under the bolt that engages the bolt after the last round is fired. When the last round is fired, the bolt comes back to complete the cycle and eject the round. As the bolt reaches the rearward position, it is caught by a pin or lever of the bolt catch. The bolt catch holds the bolt in a rearward position, thereby allowing the magazine to be replaced and the following round to be chambered without charging the action. The bolt catch includes a release mechanism that allows a user to move the bolt catch from an engaged to a disengaged position.

The forward assist and the bolt catch release are typically placed so as to facilitating the preferences of a right-handed shooter. In addition, the bolt catch release is typically placed in a position such that one or both hands must be removed from the firing position in order to actuate the release.

BRIEF DESCRIPTION OF THE FIGURES

Advantages of the invention will become apparent upon reading the following detailed description and upon reference to the drawings.

DETAILED DESCRIPTION

Embodiments of the invention include a linkage that integrates movement of left and right forward assists. Further embodiments include a linkage connecting one or both of the forward assists to the bolt catch. In still further embodiments, the invention may included both a connection between the left and right forward assists as well as a connection between one or both of the forward assists and the bolt catch. Embodiments of the present invention may include any firearm that comprises a forward assist and a bolt catch and, in a preferred embodiment, an AR Rifle style upper receiver with left and right forward assists that also release the bolt catch.

Advantages of the present invention include, but are not limited to the following: allowing ambidextrous control of the firearm, including the forward assist and bolt catch release; allowing an operator to release the bolt while remaining on target; allowing faster reload through minimized operator motion; removing the need to remove the forward hand from the firing position in order to release the bolt; an ability to use traditional lower receiver mounting point of bolt catch release for a left side magazine release button; and allowing an operator to maintain grip on a pistol grip while operating the forward assist or bolt catch release.

This system applies to semi-automatic firearms in general and particularly to AR-15/AR-10 rifles, as well as all related platforms, including but not limited to M-16/M-4 Rifles. The system also applies to all caliber projectiles from said rifles, including sub-caliber and/or pistol caliber projectiles. One of ordinary skill in the art would also understand that the features of the present invention could be applied to other firearms.

Throughout this application, the directional references, such as forward, rearward, left, right, bottom and top, will be used. These and other such references are relative to the firing direction of the firearm, which fires in a forward direction. Such references are used for ease in describing the present invention and should not be construed as limiting the scope of the invention. As used in the description herein and throughout the claims, the following terms take the meanings explicitly associated herein, unless the context clearly dictates otherwise: the meaning of "a," "an," and "the" includes plural reference, the meaning of "in" includes "in" and "on." Also, reference designators shown herein in parenthesis indicate components shown in a figure other than the one in discussion.

Figure 1:
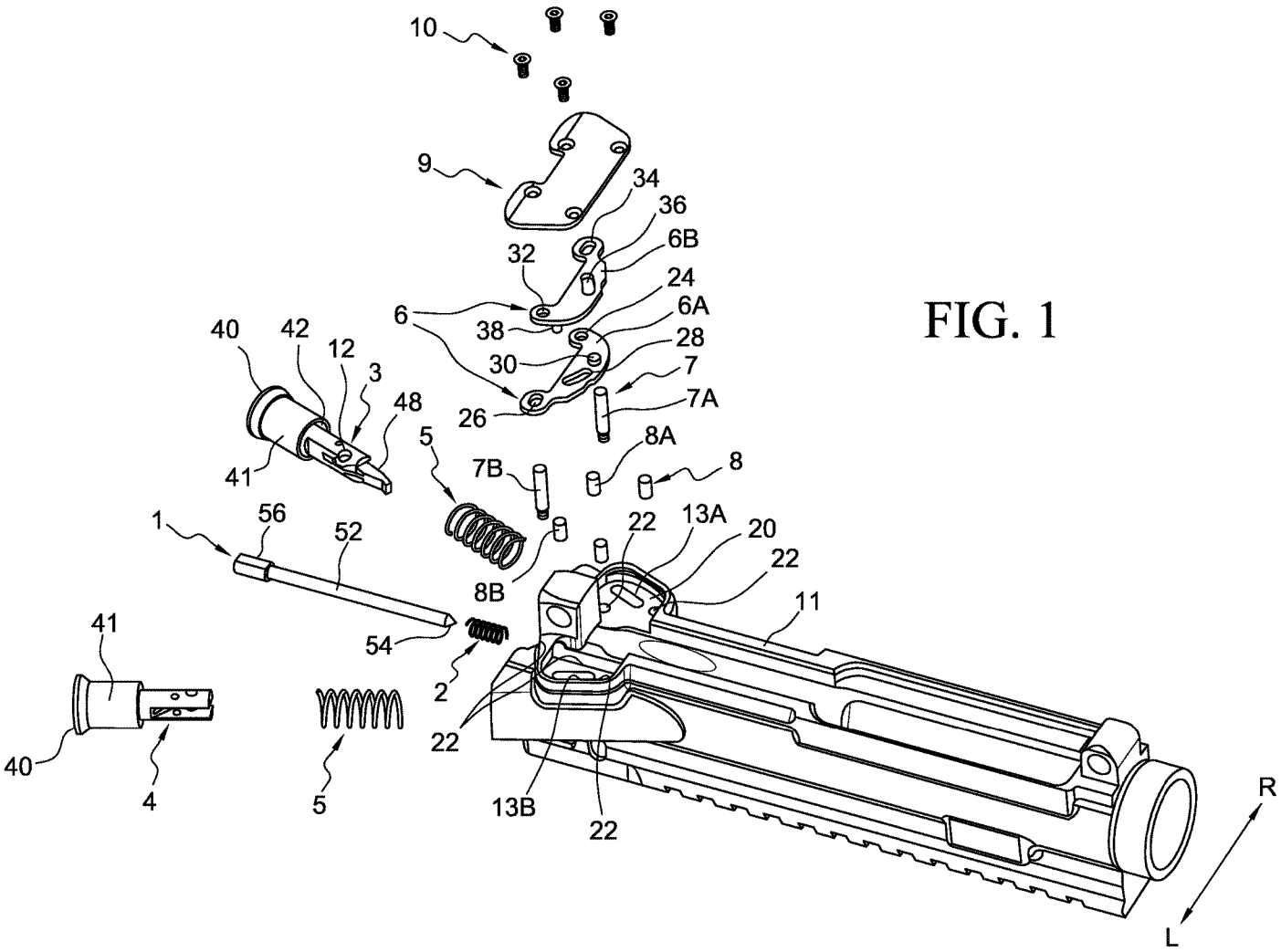
FIG. 1 is an exploded view of an upper receiver in accordance with an embodiment of the invention as viewed from an under side of the receiver.

As illustrated in FIG. 1, embodiments of the present invention comprise an upper receiver 11 with dual forward assists. FIG. 1 is a bottom view of the upper receiver. Because of the angle of the view, the right and left sides of the receiver are not necessarily intuitive in the drawing. Arrows labeled with R and L are provided throughout the drawings to clarify the directional references discussed below. A cavity 20 is formed in a lower side of the upper receiver 11. Slots that function as linkage post guides 13A, 13B are formed in a top surface of the cavity 20. Mounting holes 22 are also formed in the top surface. These holes 22 may include threads formed on an inside surface in order to engage with mounting hardware 10. Mounting hardware 10 may comprise machine screws as illustrated in FIG. 1 but may also comprise other appropriate mounting hardware, such as rivets, press fit posts, etc. Mounting sleeves 8 are positioned below and in line with mounting holes 22. The mounting sleeves may be cylindrical and hollow to allow passage of mounting hardware 10 through the sleeves 8.

Upper ends of linkage posts 7A, 7B are positioned within the linkage post guides 13 such that a free end of the posts 7A, 7B extends downwardly beyond the top surface of the cavity 20. The linkage posts may be generally cylindrical in shape and are adapted to slide within the guides 13.

A first link 6A is also positioned in the cavity 20. The link includes a through hole 24 near its right end. The hole 24 is positioned such that mounting sleeve 8A extends through the hole. The link 6A is capable of rotating around the mounting sleeve 8A. The link further includes a slot 26 near its left end through which the left linkage post 7B extends. The linkage post 7B, slot 26 and post guide 13B are formed and positioned such that as the post 7B is pushed forward, the link 6A rotates around mounting sleeve 8A in a counterclockwise manner as viewed from the bottom. In addition, the link includes a second slot 28. This slot may be formed in a central portion of the link and may have an arcuate shape. The link may also include a post 30 extending downwardly from a bottom surface of the link 6A.

A second link 6B is also positioned in the cavity 20 below the first link 6A. The second link includes a through hole 32 near its left end. The hole 32 is positioned such that mounting sleeve 8B extends through the hole. The link 6B is capable of rotating around the mounting sleeve 8B. The link further includes a slot 34 near its left end through which the right linkage post 7A extends. The linkage post 7A, slot 34 and post guide 13A are formed and positioned such that as the post 7A is pushed forward, the link 6B rotates around mounting sleeve 8B in a clockwise manner as viewed from the bottom. In addition, the link includes a second slot 36. This slot may be formed in a central portion of the link and may have an arcuate shape. The link may also include a post 38 (not visible) extending upwardly from a top surface of the link 6B.

Figure 2:
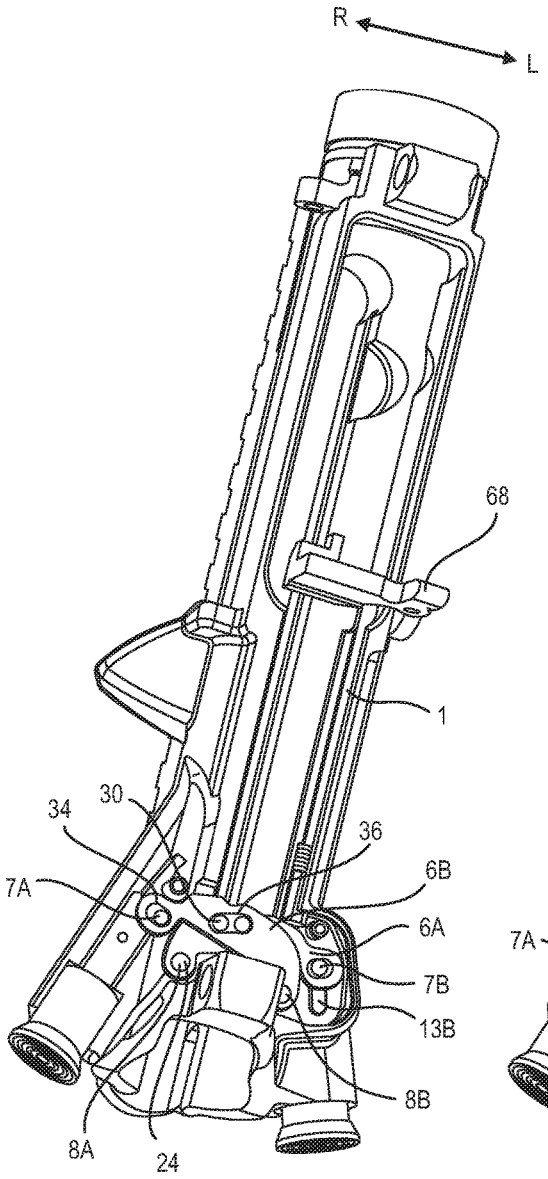
FIG. 2 is an isometric bottom view of an upper receiver in accordance with the embodiment of FIG. 1 showing the forward assists in a forward position.
Figure 3:
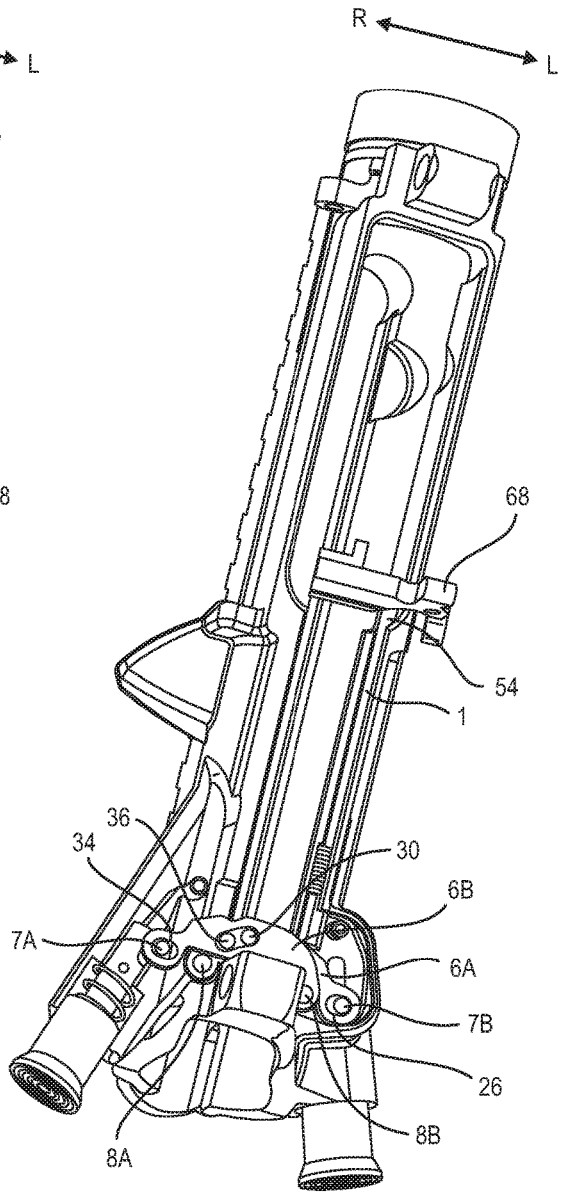
FIG. 3 is an isometric bottom view of an upper receiver in accordance with the embodiment of FIG. 1 showing the forward assists in a rearward position.
Figure 4:
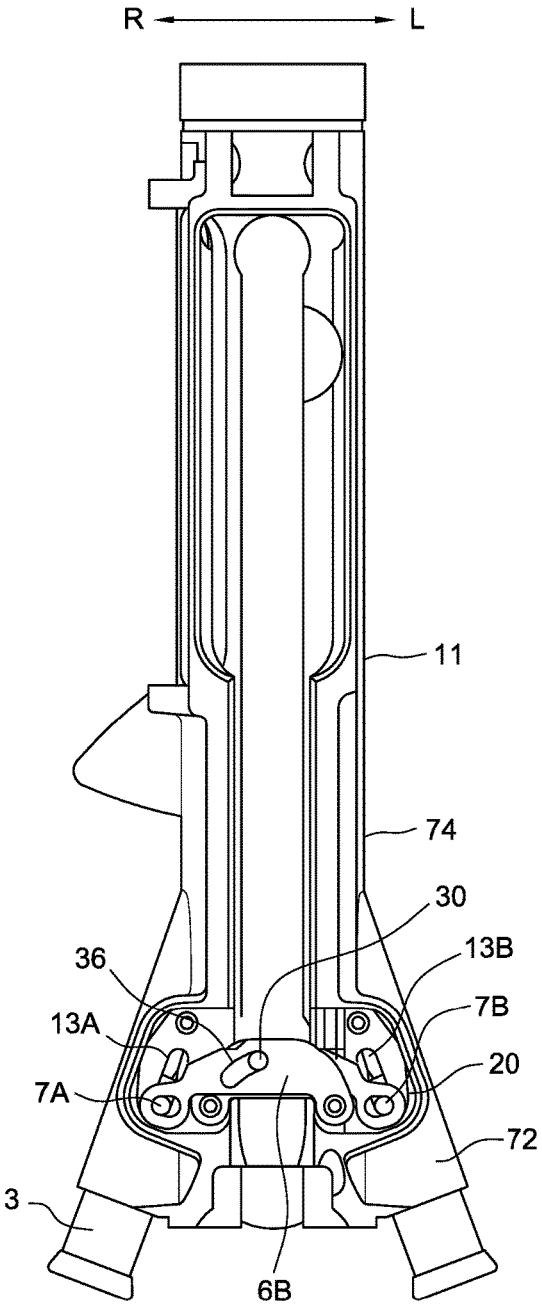
FIG. 4 is a bottom view of an upper receiver in accordance with the present invention.
Figure 5:
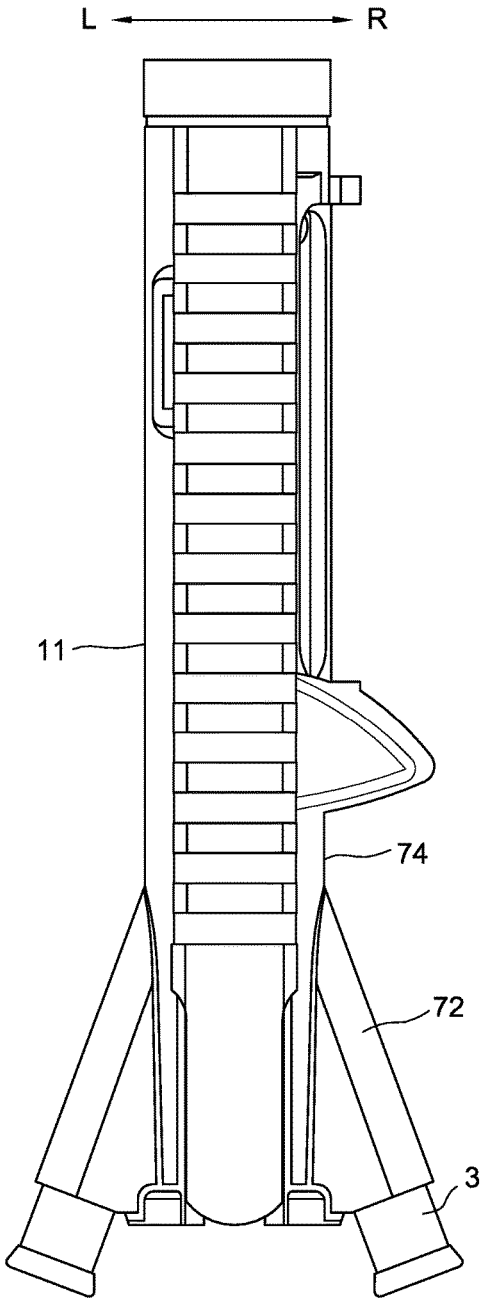
FIG. 5 is a top view of an upper receiver in accordance with the embodiment of FIG. 4.

The posts 30, 38 and slots 28, 36 of the links 6A, 6B coordinate to form a linkage that operates as illustrated in FIGS. 2-3. FIG. 3 shows an embodiment of the mechanism in which the linkage posts 7A, 7B are in a rearward position. The linkage posts 7A, 7B may be moved forward by the actuation of respective forward assists 3, 4 as described more fully below. As the left post 7B moves forward in the guide slot 13B, the post acts on the surface of slot 26 in link 6A. The link rotates in a counterclockwise manner around mounting sleeve 8A until the post 7B and link 6A reach the forward position illustrated in FIG. 2.

When post 7B is moved forward and upper link 6A rotates in counterclockwise direction, engagement between post 30 of the upper link 6A and arcuate slot 36 of the lower link 6B and between post 38 of the lower link 6B and the arcuate slot 28 of the upper link 6A cause the lower link 6B to rotate in a clockwise direction around mounting sleeve 8B. This clockwise rotation of link 6B causes post 7A to move in a forward direction. Conversely, if post 7A is moved forward, link 6B rotates in a clockwise direction, causing link 6A to rotate in a counterclockwise direction and post 7B to move forward. Accordingly, movement of one post causes corresponding movement of the other post.

Returning to FIG. 1, embodiments of the invention include a right forward assist 3 and a left forward assist 4. The forward assists include a thumb pad 40 at a rearward end of each assist. Each assist also includes a hole 12 that passes through at least a portion of the assist and engages respective linkage posts 7A, 7B. Accordingly, when a user pushes on a thumb pad 40, the corresponding forward assist 3, 4 moves forward. This in turn moves the corresponding linkage post 7A, 7B forward as described above. Embodiments may also include one or more springs 5 that applies rearward pressure on one or both of the forward assists 3, 4. The forward assist may include a cylindrical body section 41 that includes a cylindrical recess 42 that surrounds a rearward end of the spring 5. In alternative embodiments, either the body section 41, the recess 42 or both may have a different shape, such as oval, square or other appropriate cross-section or shape.

Referring to FIGS. 4-7, the right forward assist 3 is slidably positioned within a recess 44 formed in the upper receiver body 11. The recess 44 may be formed within a protrusion 72 that extends from a sidewall 74 of the receiver body 11. The recess 44 may be cylindrical in shape and connect with the cavity 20. The recess may extend at an angle to a centerline of the firearm so that the forward assist is linearly actuated in a direction that is not parallel to the barrel (80) of the firearm. A shoulder 46 is positioned at a forward end of the recess 44. The spring 5 is positioned in the recess 44 against the shoulder 46 such that it applies rearward return pressure on the forward assist 3 when it is pushed forward. The forward assist may also include an arm 48 that extends from a forward end of the assist 3. The arm 48 may include a tooth 50 or other engaging surface that engages with notches formed on the bolt carrier in order to push the bolt forward.

The left forward assist 4 may include any or all of these features. However, with the present invention it is not necessary for the left forward assist to directly engage the bolt carrier. As described above, operation of the left forward assist 4 will operate the links 6 and cause the right forward assist 3 to move forward and engage the bolt carrier.

Returning to FIG. 1, embodiments of the invention include a wedge 1. The wedge may have a shaft 52, an angled tip 54 at a forward end, and a shoulder 56 at a rearward end. The shaft may be cylindrical in shape and a spring 2 may be sized to surround the shaft 52. Alternatively, the shaft may be square, rectangular, oval or some other shape.

Figure 6:
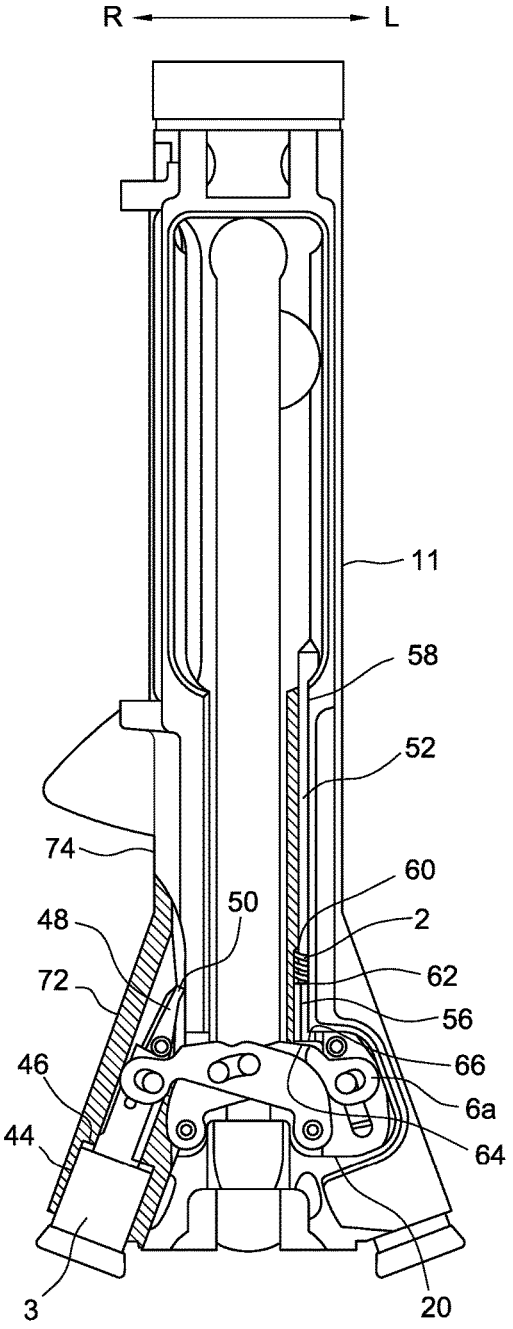
FIG. 6 is a partial cutaway bottom view of an upper receiver in accordance with the present invention showing the forward assists in a forward position.
Figure 7:
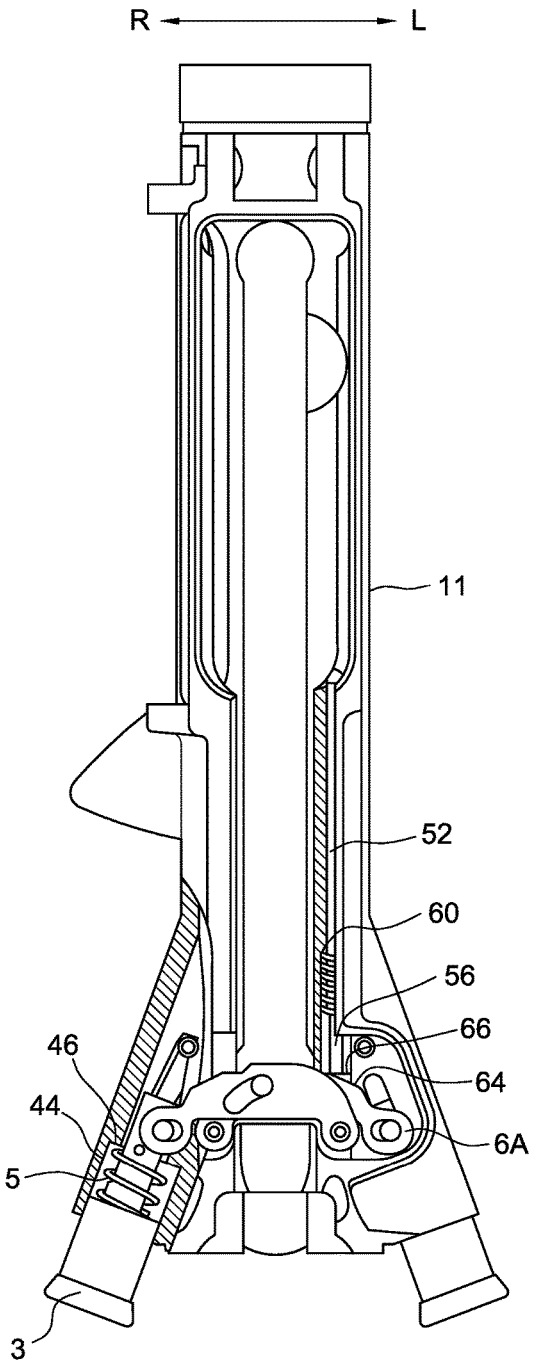
FIG. 7 is a partial cutaway bottom view of an upper receiver in accordance with the present invention showing the forward assists in a rearward position.

As shown in FIGS. 6-7 the wedge 1 may be positioned within a passageway 58 formed in the upper receiver 11 and connected with the upper receiver cavity 20. The passageway includes a shoulder 60 formed toward the rearward end of the passageway. The spring 2 surrounds the wedge shaft and is positioned between a rearward surface of the passageway shoulder 60 and a forward surface 62 of the wedge shoulder 56. In this manner, as the wedge 1 is pressed forward, the spring 2 is compressed, which applies a biasing pressure that tends to return the wedge to its rearward position. The passageway 58 may have a shape that corresponds to the shape of the shaft 52 of the wedge 1. For example, the passageway may have a square internal profile that corresponds to a square external profile of the shaft. Such a correspondence between the shape of the passageway 58 and shaft 52 may prevent the shaft, and therefore wedge 1, from rotating within the passageway.

Link 6A includes a surface 64 on a forward edge of the link. This surface engages a rear surface 66 or the wedge shoulder 56. Accordingly, as a forward assist 3, 4 is pushed forward, link 6A is rotated in a counterclockwise manner. As link 6A rotates, surface 64 applies a force to the wedge, which drives the wedge forward against the resilient force of the spring 2. When the forward assist is released, spring 5 applies a force that drives the assist in a rearward direction, and wedge spring 2 applies a force that drives the wedge in a rearward direction.

As shown in FIGS. 2-3, the wedge 1 engages with the bolt catch 68 of the firearm. As the wedge is pushed forward by operation of the forward assist 3, 4, the angled tip 54 of the wedge presses against the bolt catch 68. As the wedge slides forward, it forces the bolt catch to rotate from a latched position to an unlatched position, thereby releasing the bolt. Accordingly, operation of either forward assist operates to drive the bolt forward and/or to release the bolt catch.

Figure 8:
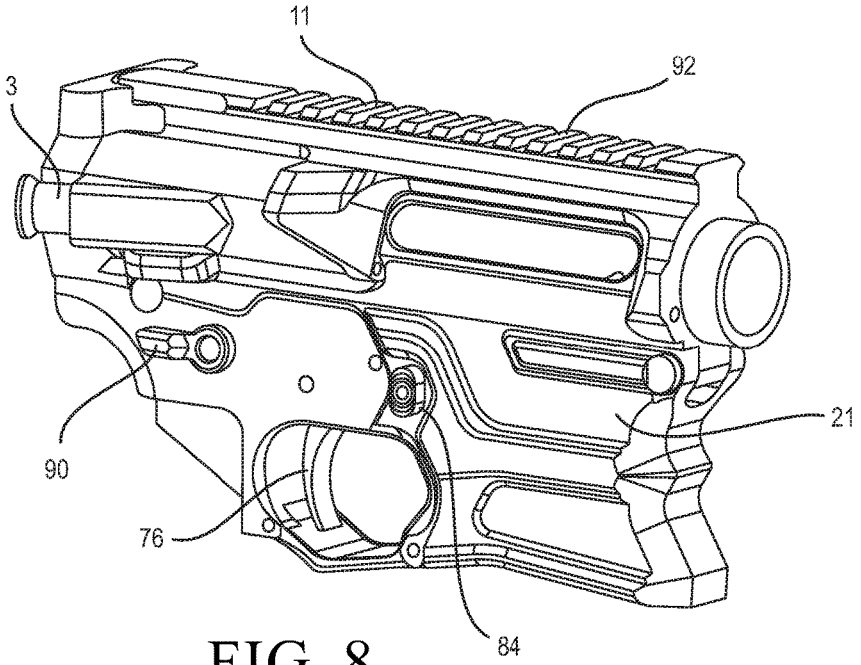
FIG. 8 is an isometric view of the right side of an upper and lower receiver in accordance with an embodiment of the invention.
Figure 9:
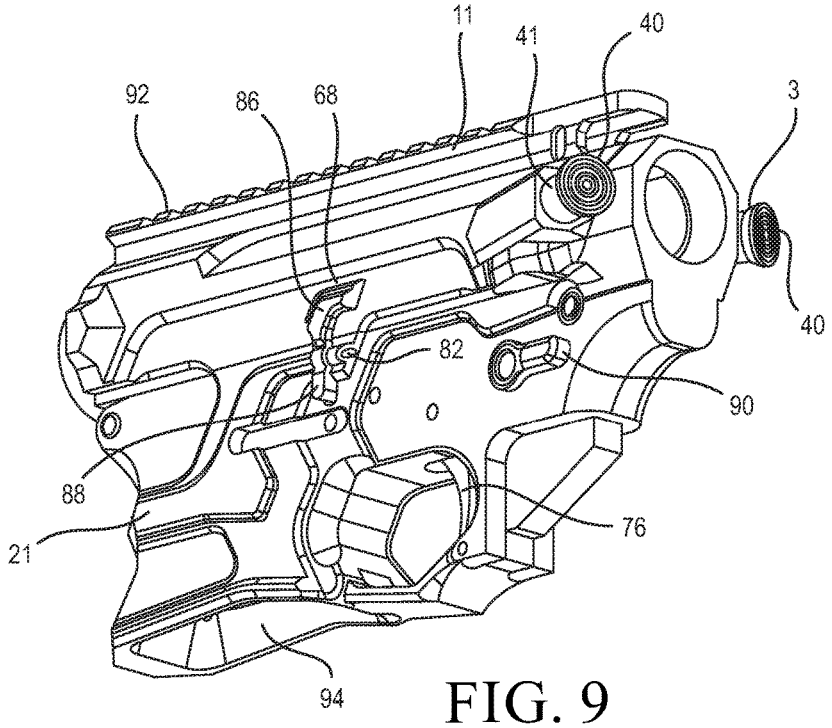
FIG. 9 is an isometric view of the left side of an upper and lower receiver in accordance with an embodiment of the invention.

As illustrated in FIGS. 8-9, the upper receiver 11 is attached to a lower receiver 21. The lower receiver 21 includes a trigger mechanism 76. The bolt catch 68 may be configured to pivot around a shaft 82 connected to the lower receiver. The bolt catch 68 may include a first lever arm with an actuation surface 86 for disengaging the bolt catch from the bolt carrier and a second lever arm with an actuation surface 88 that allows the user to pivot the bolt catch 68 into an engaged position. The lower receiver may include a cavity 94 for engaging a magazine and a magazine release 84. The lower receiver may also include one or more safety engagement levers 90. The upper receiver 11 may include a mechanism for attaching a scope or other accessories to the rifle. This mechanism may be a Picatinny rail 92 or other attachment mechanism.

Figure 10:
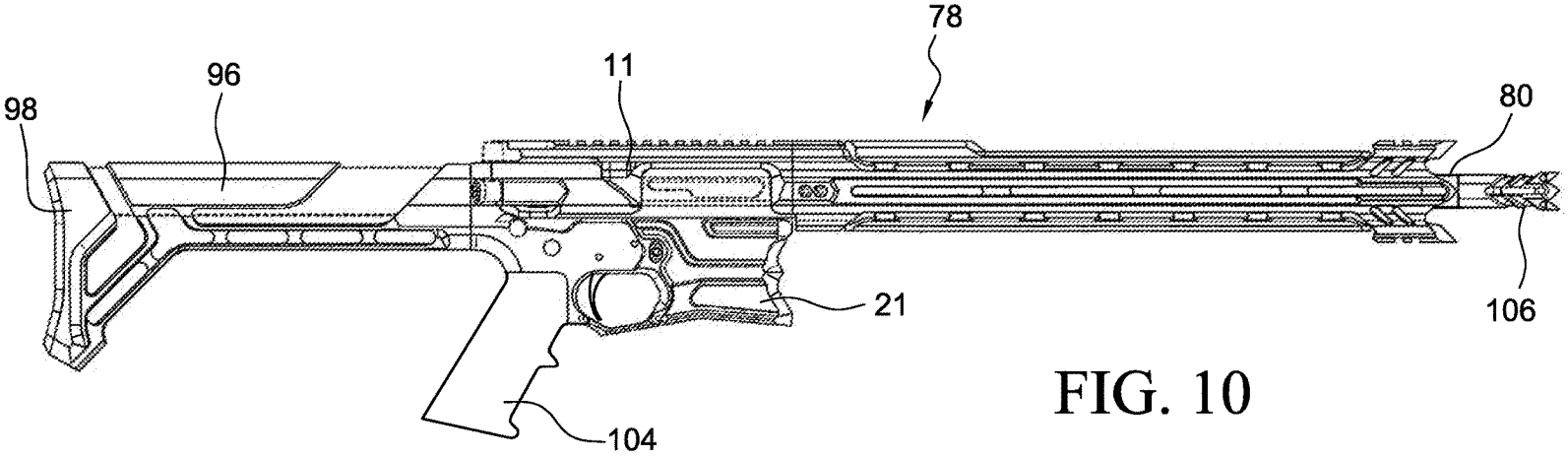
FIG. 10 is a view of the right side of a rifle in accordance with an embodiment of the invention.
Figure 11:
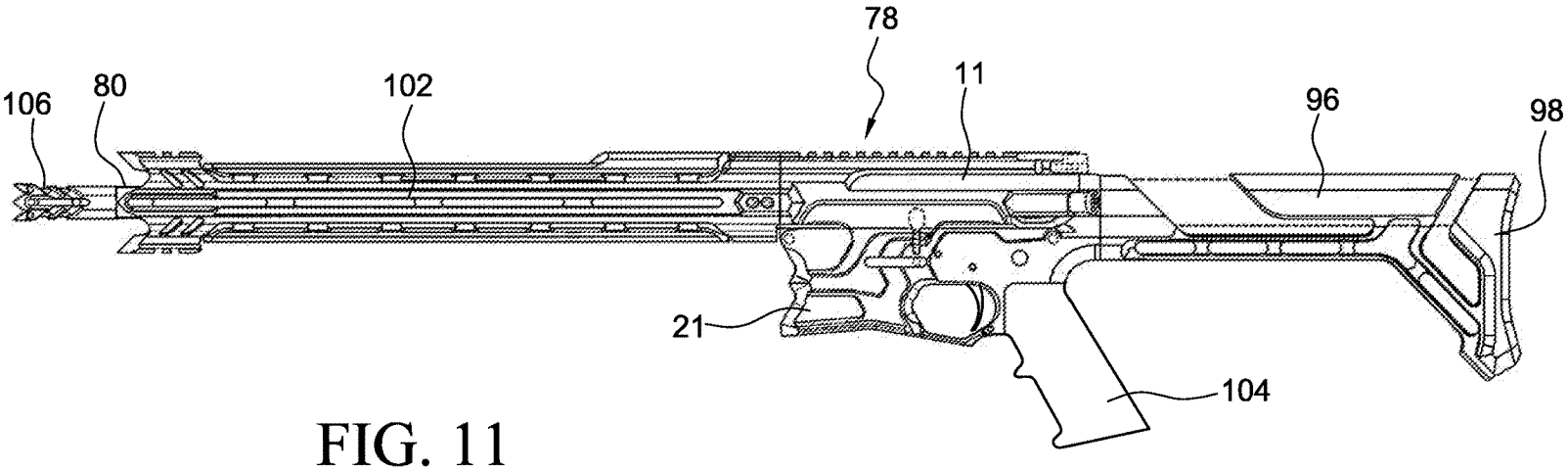
FIG. 11 is a view of the left side of the rifle in accordance with the embodiment of FIG. 10.

FIGS. 10-11 illustrate an embodiment of a rifle 78 in accordance with the present invention. The illustrative rifle includes an upper receiver 11 and a lower receiver 21. The rifle 78 includes a barrel 80 that is connected at a rearward end to the upper receiver 11. The rifle also includes a stock 96 with a shoulder pad 98. The rifle may also include a hand guard 102 that surrounds at least a portion of the barrel 80 and may include a pistol style grip 104. In addition, the rifle may include a flash suppressor 106 or other device mounted to the forward end of the barrel.

Figure 12:
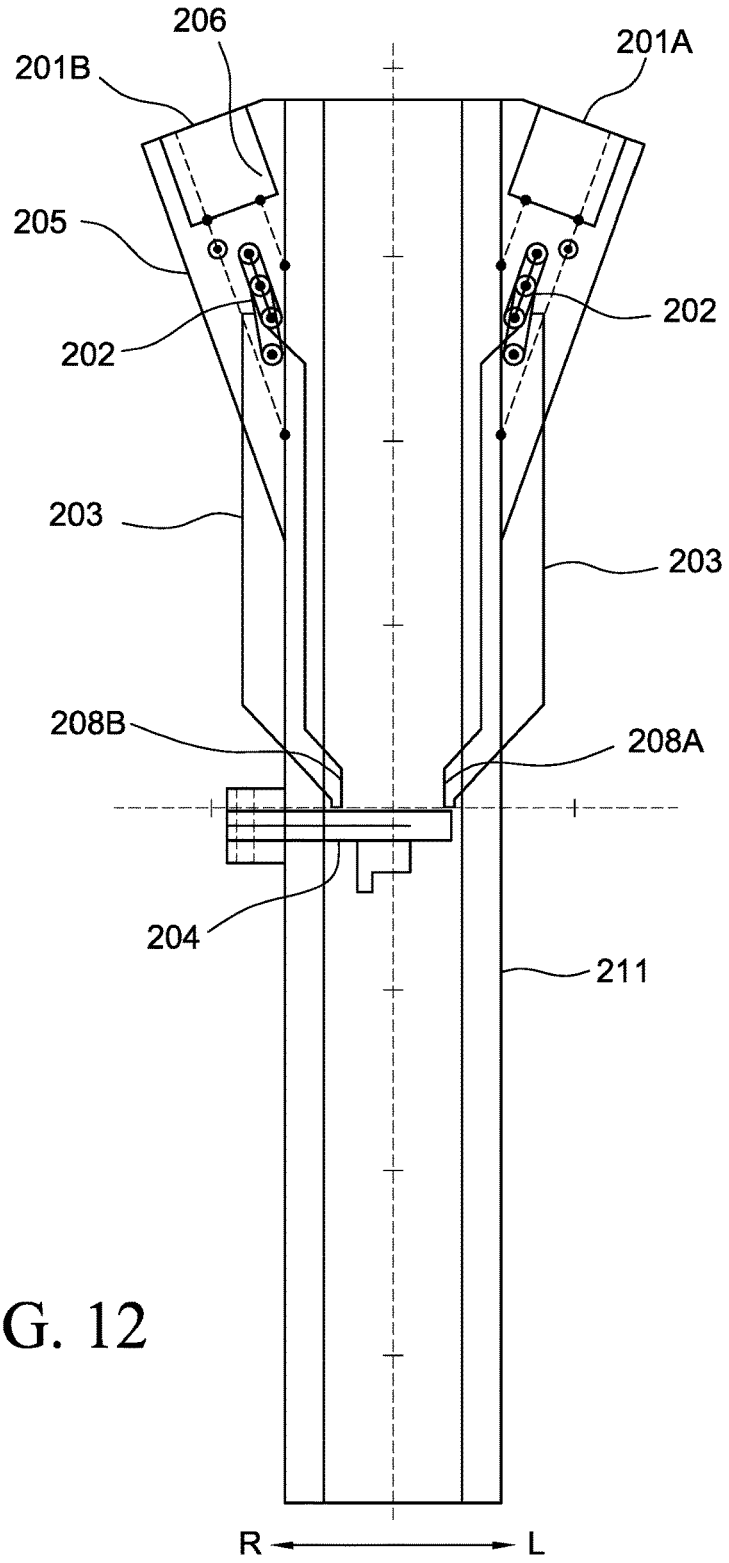
FIG. 12 is a diagrammatic top view of an upper receiver in accordance with an embodiment of the invention with portions of the receiver removed in order to show internal components.
Figure 13:
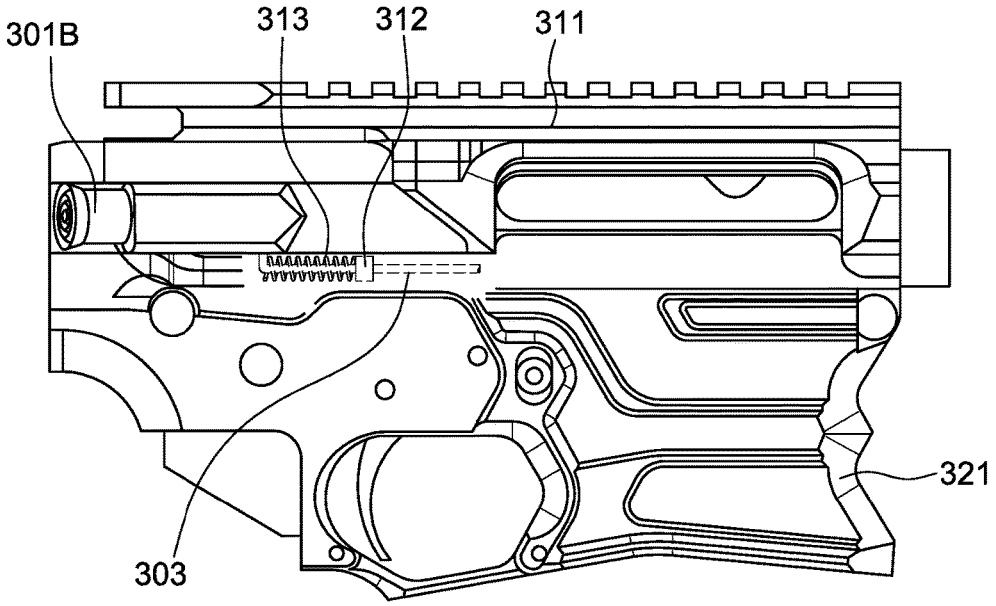
FIG. 13 is a view of the right side of a receiver in accordance with an embodiment of the invention.
Figure 14:
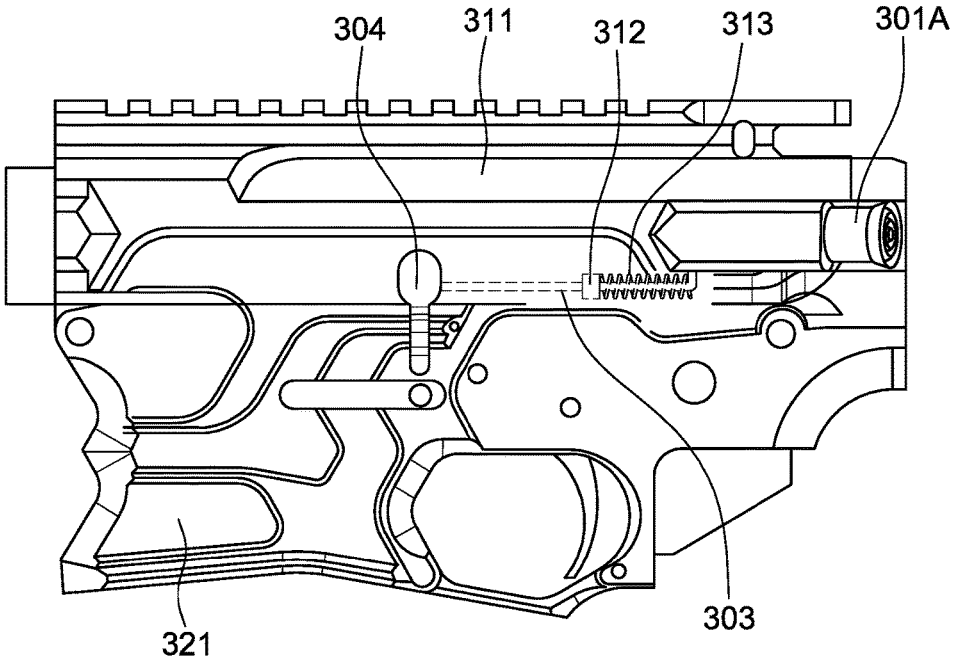
FIG. 14 is a view of is a view of the left side of the receiver in accordance with the embodiment of FIG. 13.

FIGS. 12-14 illustrate a further embodiment of the invention. As illustrated diagrammatically in FIG. 12, a combined forward assist and bolt catch release button 201A, 201B is positioned on either side of the upper receiver 211. The left side assist/release 201A engages notches 208A formed on the left side of the bolt carrier (not shown) while the right side assist/release 201B engages notches 208B formed on the right side of the bolt carrier (not shown). In addition, each assist/release 201 engages a respective disconnect lever linkage 202. A separate disconnect lever linkage 202 is operatively connected to each assist/release 201 on opposing sides of the upper receiver. Each disconnect lever linkage 202 engages a respective disconnect lever 203. A separate disconnect lever 203 is operatively connected to each disconnect lever linkage 202 on opposing sides of the upper receiver. Both disconnect levers 203 engage a bolt catch mechanism 204.

The bolt catch mechanism 204 engages the bolt carrier (not shown) when the final round in a magazine is fired such that the bolt is held in the rearward position, allowing the magazine to be replaced with a magazine containing rounds. The bolt catch mechanism 204 can then be released by actuating the assist/release button 201, allowing the bolt to move forward and chamber the waiting round.

The upper receiver 211 may include forward assist support block 205 that provides support for the assist/release 201 and the disconnect lever linkage 202. In the illustrated embodiment, the assist/release 201 is a generally circular button that includes a shaft portion extending into a recess 206 formed in the support block 205. This allows the assist/release to move linearly within the support block. The support block 205 holds the assist/release 201 at an angle relative to the centerline of the firearm. The disconnect lever linkage 202 transfers the angled linear motion of the assist/release 201 into a linear motion of the disconnect lever 203, which in turn actuates the bolt catch mechanism 204 while also pushing the bolt carrier forward by engaging notches 208.

As illustrated in FIGS. 13-14, embodiments of the invention include an upper receiver 311 and a lower receiver 321. A forward assist 301A, 301B extends from each side of the receiver. Each forward assist engages notches formed on a respective side of the bolt carrier (not shown). In addition, each forward assist 301A, 301B engages a respective disconnect link 303. The disconnect link is mechanically connected between the forward assist 301 and the bolt catch mechanism 304. Embodiments may further comprise additional links between the forward assists 301 and the bolt catch 304 that transfer the angled linear motion of the assist/release 301 into a linear motion of the disconnect link 303, which in turn actuates the bolt catch mechanism 304 while also pushing the bolt carrier forward. The disconnect link may comprise shaft that is surrounded by a collar 312 to constrain the link for linear movement. The linkage may also include one or more springs 313 that act to return the link 303 and forward assist 301 to a rearward position. The disconnect link 303, spring 313 and other components of the linkage may be exposed on an outer surface of the firearm, may be at least partially concealed by a cover, or may be positioned within the upper or lower receivers.

This application describes various exemplary embodiments of linkages formed from one or more links. The linkages shown and described herein may include more or fewer links, and each of the referenced links may itself include a single, generally rigid link, may include multiple links or link portions that cooperate mechanically with each other, or may include a combination of flexible and rigid links or portions of links.

The firearms and components of the present invention have been described herein as having certain exemplary features. However, it is not intended that the invention be limited to these illustrative embodiments, and it is contemplated that the present invention may include any compatible feature or configuration as would be understood by one of ordinary skill in the art.

We claim:

1. A receiver for a firearm comprising:

a bolt carrier comprising a notch formed in a surface of the bolt carrier;

a first forward assist comprising: a body section and a thumb pad;

a second forward assist comprising: a body section, a thumb pad, and a tooth that engages the bolt carrier notch;

a linkage connecting the first forward assist mechanism with the second forward assist mechanism the linkage comprising: a first rotatable link connected with the first forward assist mechanism, and a second rotatable link connected with the second forward assist mechanism, the first rotatable link being further connected with the second rotatable link.

2. The receiver of claim 1 wherein the first forward assist comprises an axis of linear movement that is at a first angle with respect to a central axis of a barrel of the firearm.

3. The receiver of claim 2 wherein the second forward assist comprises an axis of linear movement that is at a second angle with respect to the central axis of the barrel of the firearm.

4. The receiver of claim 1 wherein the first rotatable link comprises a first pivot point at a first end and a first slot at a second end, and wherein the first forward assist further comprises a first post that is positioned at least partially within the first slot.

5. The receiver of claim 4 wherein linear movement of the first forward assist imparts rotational movement to the first rotatable link.

6. The receiver of claim 4 wherein the second rotatable link comprises a second pivot point at a first end and a second slot at a second end, and wherein the second forward assist further comprises a second post that is positioned at least partially within the second slot.

7. The receiver of claim 6 wherein rotational movement of the second rotatable link imparts linear movement to the second forward assist.

8. The receiver of claim 6 wherein the first rotatable link further comprises a first link post and a third slot, and the second rotatable link further comprises a second link post and a fourth slot.

9. The receiver of claim 8 wherein the first link post is positioned within the fourth slot, and the second link post is positioned within the third slot.

10. The receiver of claim 9 wherein rotational movement of the first rotatable link imparts rotational movement to the second rotatable link.

11. The receiver of claim 9 wherein:

linear movement of the first forward assist imparts rotational movement to the first rotatable link;

rotational movement of the first rotatable link imparts rotational movement to the second rotatable link; and rotational movement of the second rotatable link imparts linear movement to the second forward assist.

12. The receiver of claim 11 wherein the rotational movement of the first rotatable link is in a direction opposite to the rotational movement of the second rotatable link.

13. The receiver of claim 1 further comprising a bolt catch rotatable between an engaged position and a disengaged position.

14. The receiver of claim 13 further comprising a bolt catch linkage connecting the first forward assist with the bolt catch.

15. The receiver of claim 14 wherein actuation of the first forward assist moves the bolt carrier in a direction parallel to a central axis of the firearm and rotates the bolt catch from the engaged position to the disengaged position.

16. A receiver for a firearm comprising:

a bolt carrier comprising a notch formed in a surface of the bolt carrier;

a first forward assist comprising a first axis of linear movement that is at a first angle with respect to a central axis of a barrel of the firearm;

a second forward assist comprising a second axis of linear movement that is at a second angle with respect to the central axis of the barrel;

a linkage connecting the first forward assist with the second forward assist such that actuation of the first forward assist along the first axis of linear movement moves the second forward assist along the second axis of linear movement.

17. The receiver of claim 16 wherein movement of the second forward assist along the second axis of linear movement moves the bolt carrier in a direction parallel to the central axis of the barrel.

18. The receiver of claim 17 further comprising a bolt catch.

19. The receiver of claim 18 further comprising a bolt catch linkage connecting the first forward assist with the bolt catch.

20. The receiver of claim 19 wherein actuation of the first forward assist rotates the bolt catch from an engaged position to a disengaged position.

* * * * *